United States Patent [19]

McHugh

[11] 4,177,940

[45] Dec. 11, 1979

[54] FLOCK FIBER FEEDING APPARATUS HAVING A PLURALITY OF IMPELLERS AND A VENTURI FLOW TUBE

[75] Inventor: John P. McHugh, Lexington, Ky.

[73] Assignee: Solar Suede Corporation, Lexington, Ky.

[21] Appl. No.: 783,801

[22] Filed: Apr. 1, 1977

[51] Int. Cl.[2] ..... B67D 5/54

[52] U.S. Cl. ..... 222/636; 222/227; 222/240

[58] Field of Search ..... 222/148, 193–194, 222/227, 239–242, 342, 373; 302/49, 51, 57

[56] References Cited

U.S. PATENT DOCUMENTS

| | | | |
|---|---|---|---|
| 1,674,391 | 6/1928 | Dunnagan | 222/193 |
| 1,750,147 | 3/1930 | Wright | 222/193 |
| 1,752,956 | 4/1930 | Lex | 222/193 |
| 2,740,230 | 4/1956 | Clapper | 222/193 X |
| 2,770,912 | 11/1956 | Deem | 222/193 |
| 2,795,079 | 6/1957 | Santarelli | 222/193 |
| 3,201,001 | 8/1965 | Roberts et al. | 222/194 |
| 3,251,512 | 5/1966 | Irving | 222/227 X |
| 3,347,469 | 10/1967 | Ross et al. | 239/302 X |
| 3,528,588 | 9/1970 | Moore | 222/193 |

*Primary Examiner*—Robert J. Spar
*Assistant Examiner*—Fred A. Silverberg
*Attorney, Agent, or Firm*—Jenkins, Coffey, Hyland, Badger & Conard

[57] ABSTRACT

Apparatus for feeding flock fibers comprising an upwardly open flock-receiving hopper. The hopper has a bottom discharge passage under which is mounted metering apparatus providing a plurality of discharge openings of controllably variable size. An upper impeller having a plurality of downwardly angled blades is rotatably driven within the hopper passage to urge the flock fibers to fall downwardly through the discharge openings into a cylindrical pump chamber. A lower impeller is rotatably driven within the pump chamber to sweep falling flock fibers into a pump throat in communication with a venturi flow tube through which a supply of air is passed. The air flowing through the venturi flow tube creates suction to draw the fibers within the throat into the venturi flow tube for entrainment with the air stream.

10 Claims, 7 Drawing Figures

Fig. 4
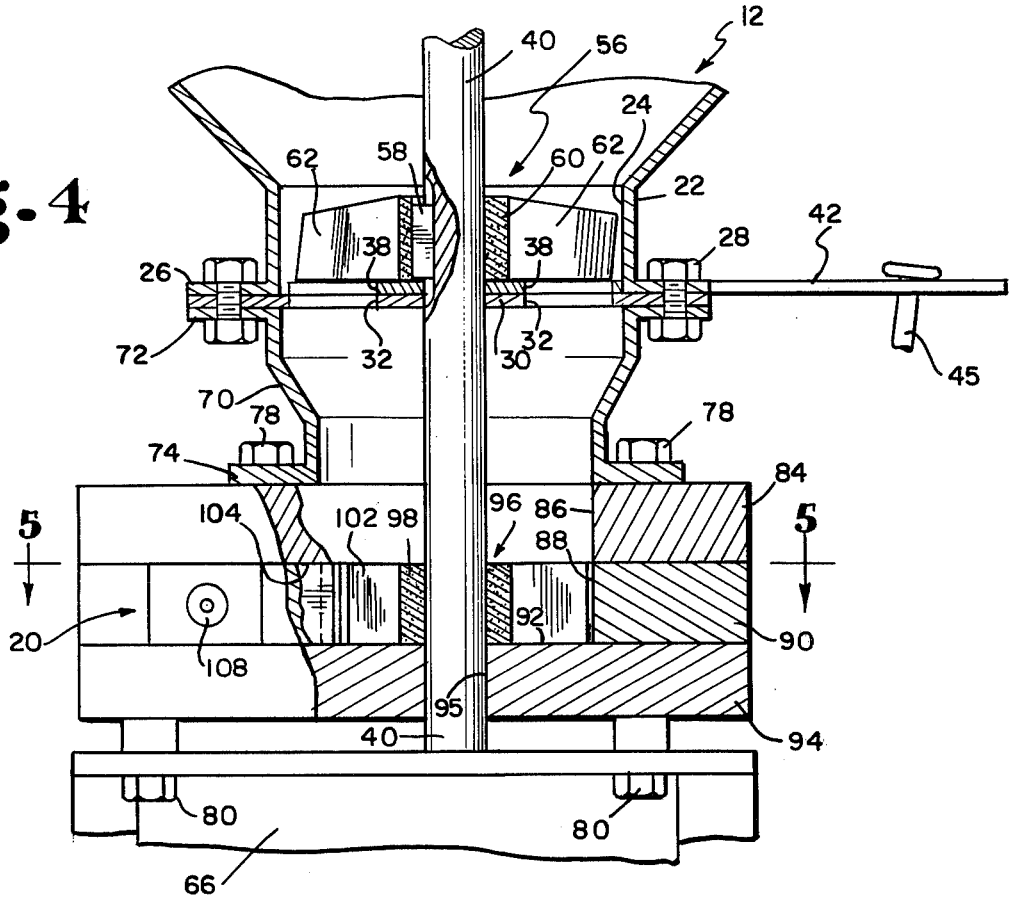
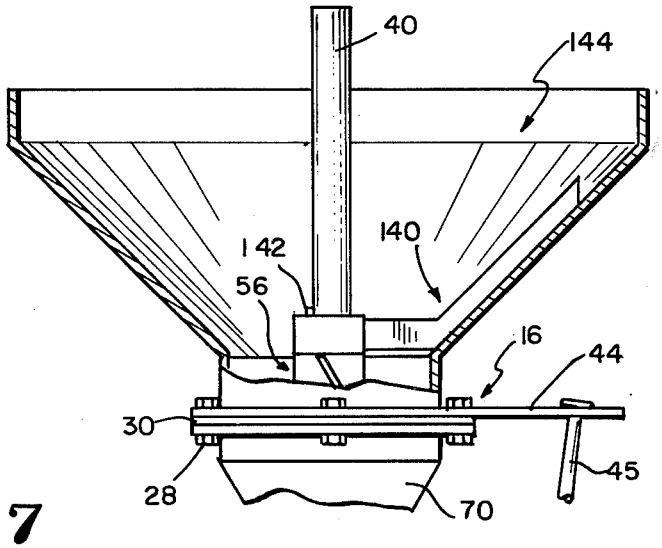
Fig. 7

FLOCK FIBER FEEDING APPARATUS HAVING A PLURALITY OF IMPELLERS AND A VENTURI FLOW TUBE

BACKGROUND OF THE INVENTION

This invention relates to apparatus for feeding flock fibers. More specifically, this invention relates to apparatus for feeding flock fibers at a variably controlled rate for entrainment with a propelling air stream.

In the electrostatic flocking industry, flock fibers comprising relatively short, thin lengths of material such as nylon or rayon are delivered from a bulk supply of fibers into the presence of an electrostatic field for deposition onto the surface of an adhesive-coated article. Desirably, the fibers are separated and aligned prior to deposition on the article, and are delivered to the article at a sufficient uniform rate to permit rapid coating with a flock surface of high quality. However, it is well known that flock fibers, unlike particles such as powdered paint, tend to clump together and become tangled when delivered from a bulk supply. This undesirably tends to clog the delivery equipment, and to cause incomplete fiber separation and alignment within the electrostatic field to yield flock surfaces of poor quality.

In the prior art, one common way to feed flock fibers from a bulk supply has been to use a so-called fluidic bed. A fluidic bed comprises a flock supply bin having air streams directed upwardly through the fibers to create a suspended fiber cloud. Alternately, timed air streams are directed downwardly onto the surface of a supply of fibers to create the fiber cloud. See, for example, U.S. Pat. No. 3,850,659. An electrostatic field is created in the vicinity of the fiber cloud whereby the fibers are deposited on the surface of the desired article, or alternately, an air stream is passed through the cloud to entrain a portion of the suspended fibers for direction toward the surface of the article. These fluidic beds are advantageous in that they are relatively inexpensive in construction, operation, and maintenance. However, the maximum rate at which fibers can be delivered to the surface of an article to be coated is undesirably slow. Moreover, it has been found that the flock flow rate with fluidic beds is relatively non-uniform to result in correspondingly non-uniform surface coatings.

Some flock feeding systems in the prior art have utilized various hopper constructions in an effort to improve the rate and uniformity of flock delivery. Some of these devices comprise a flock supply hopper having a relatively narrow discharge passage through which fibers are gravitationally fed. See, for example, U.S. Pat. Nos. 2,173,032 and 2,992,126. Such hoppers have not, however, provided the necessary separation of fibers to prevent clogging of the discharge passage, or to prevent small fiber clumps from being deposited on the surface of an article. Other hopper constructions have included a screen through which the fibers are fed. See, for example, U.S. Pat. Nos. 2,223,476; 2,358,227; 2,715,074; 3,411,931; 2,768,903; 3,551,178; and 3,889,636. The use of screens improves the separation of flock fibers and thereby helps prevent fiber tangling, but such screens also tend to block and undesirably restrict the feeding of flock fibers from the hopper to limit the maximum fiber flow rate.

Flock feeding apparatus has been proposed which utilizes augers or the like for screw-feeding flock fibers from a supply hopper into a chamber for entrainment with an air stream generated by a relatively large, high speed blower. See, for example, U.S. Pat. Nos. 2,718,207 and 2,889,805. With auger systems, the delivery of fibers from the supply hopper is relatively fast. However, such augers do not satisfactorily eliminate small clumps or tangles of fibers which tend to enter the air stream and become deposited upon the surface of the article being coated.

Still another prior art flock feeding system comprises a hopper with a discharge passage through which flock fibers are fed directly to a high speed blower. See, for example, U.S. Pat. No. 3,347,469. The fibers are entrained by the blower in a relatively high volume, high velocity stream of air for propulsion toward the surface of an article being coated. However, with such high speed blowers, it is necessary in electrostatic flocking to separate the high speed air stream from the fibers prior to deposition on the article. This prevents the high volume, high velocity air stream from detrimentally affecting the quality of surface finish. Such separation of the fibers from the air stream is not desirable, however, since the required screens and baffles tend to restrict the maximum flock flow rate. See for example, U.S. Pat. No. 3,551,178. Moreover, high speed blowers are relatively expensive to obtain and maintain.

This invention overcomes the problems and disadvantages of the prior art by providing a flock feeding apparatus which provides uniform, rapid flock delivery from a supply hopper without screens or other devices restricting fiber flow rate. This invention provides such uniform, rapid flock delivery without expensive high speed air blowers and without fiber clumping or tangling.

SUMMARY OF THE INVENTION

In accordance with the invention, flock fiber feeding apparatus is provided comprising an upwardly open flock supply hopper with a metering assembly mounted under a narrowed bottom discharge passage. The metering assembly comprises a stationary feed plate with a plurality of radially extending flock discharge openings, and an adjustment plate having an identical plurality of radially extending discharge openings. The adjustment plate is rotatably mounted in sliding engagement on the feed plate for rotation about a central vertical axis common with the feed plate. The adjustment plate has an outwardly extending arm operable to rotate the adjustment plate for controllably varying the effective open area of the discharge openings for the downward passage of flock fibers. An impeller has downwardly angled blades, and is rotatably driven within the hopper discharge passage for urging the fibers downwardly through the discharge openings.

The fibers fall downwardly through the discharge openings into a cylindrical pump chamber having a flat floor. Another impeller is rotatably driven within the chamber to sweep falling flock fibers into a pump throat in communication with a venturi flow tube. A relatively low volume, low velocity stream of air is passed through the venturi flow tube for temporary acceleration of the air to create suction at the pump throat which draws fibers within said throat into the flow tube for entrainment with the air stream.

BRIEF DESCRIPTION OF THE DRAWINGS

The accompanying drawings illustrate the invention. In such drawings:

FIG. 4 is an enlarged fragmented front elevation view of a portion of the apparatus, with portions broken away;

FIG. 7 is a fragmented front elevation view of a portion of still another alternate embodiment of the invention, with portions broken away.

DETAILED DESCRIPTION OF THE PREFERRED EMBODIMENT

Figure 1:
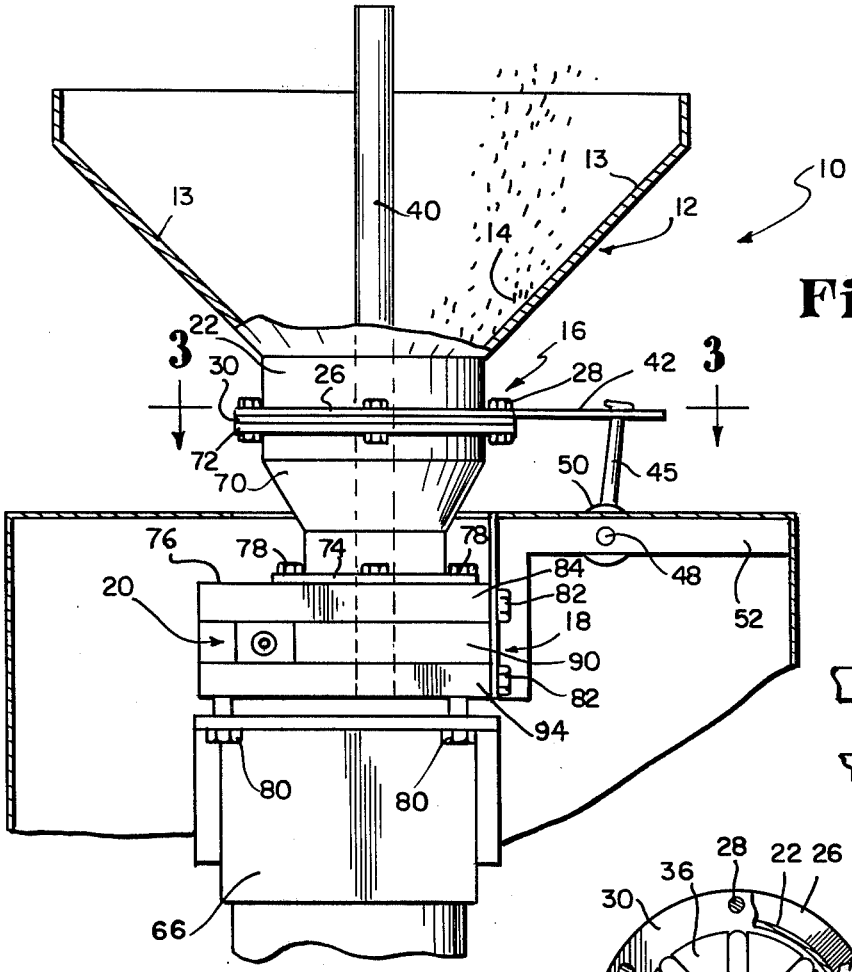
FIG. 1 is a fragmented front elevation view of flock fiber feed apparatus of this invention, with portions broken away.

Apparatus 10 of this invention for feeding flock fibers is shown in FIG. 1, and generally comprises a hopper 12 for receiving a supply of flock fibers 14. Metering apparatus 16 is mounted under the hopper 12, and serves to meter flock fibers at a selected rate downwardly into a pump housing 18. The fibers are subsequently delivered from the pump housing 18 to a venturi flow tube 20 for entrainment with a propelling air stream passing through the flow tube.

Figure 2:
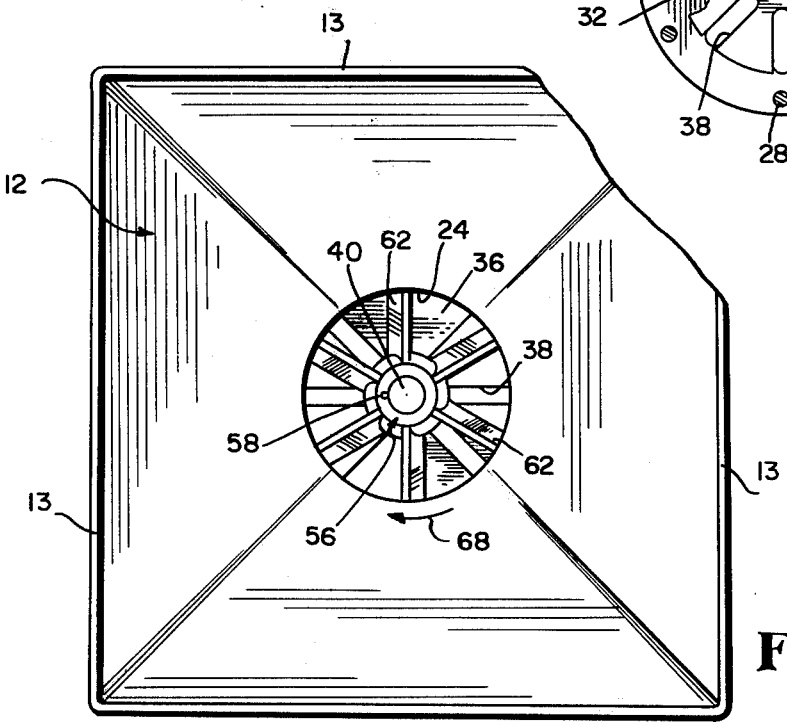
FIG. 2 is a top plan view of the apparatus of FIG. 1, with portions broken away.

The supply hopper 12 is shown in detail in FIGS. 1 and 2, and comprises an upwardly open hopper for receiving a quantity of flock fibers. The hopper has a generally rectangular cross section, with four integrally formed walls 13 being symmetrically angled downwardly and radially inwardly. The lower ends of the hopper walls 13 are joined to a cylindrical section 22 through which a downwardly open discharge passage 24 is formed. The cylindrical section 22 terminates at its lower end in a radially outwardly extending flange 26 which is connected by a series of bolts 28 to the metering assembly 16 as will be hereafter described.

Figure 3:
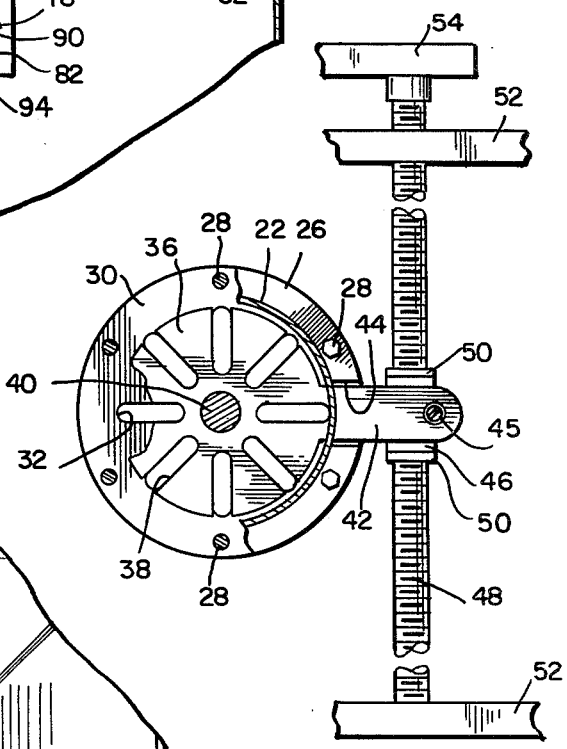
FIG. 3 is a fragmented horizontal section taken on the line 3—3 of FIG. 1, with portions broken away.

The metering assembly 16 comprises a stationary circular plate 30 formed from metal or the like, and secured in position by the bolts 28 across the bottom of the hopper discharge passage 24, as shown in FIG. 3. The stationary plate 30 has a series of radially extending discharge openings 32 for the downward passage of the flock fibers. Importantly, a circular adjustment plate 36 has a diameter for reception within the hopper discharge passage 24, and is positioned in sliding engagement on top of the stationary plate 30. The adjustment plate is also formed from metal or the like, and has formed therein a series of radially extending discharge openings 38 generally identical to the discharge openings 32 in the stationary plate 30.

The adjustment plate 36 of the metering assembly 16 is constrained for rotational movement with respect to the stationary plate 30 by a vertically extending shaft 40. More specifically, the shaft 40 extends vertically through aligned openings formed in the plates 30 and 36 to align the plates on a common vertical axis.

Importantly, the adjustment plate 36 has an adjustment arm 42 extending radially outwardly through a passage 44 formed in the hopper cylindrical section 22 and the flange 26. The outer end of the adjustment arm 42 receives the upper end of a link 45 which has its lower end secured to a sleeve 46. The sleeve 46 is received over a horizontally extending threaded rod 48 between a pair of washers 50 fixed on the rod. The opposite ends of the rod 48 are threadably received through housing members 52 for the apparatus, with one end of the rod carrying a manually operable control knob 54.

Rotation of the control knob 54 rotates the threaded rod 48 to adjust the position of the adjustment plate arm 42. That is, the arm 42 is moved by the rod to angularly rotate the adjustment plate 36 with respect to the stationary plate 30. This angularly adjusts the positions of the discharge openings 32 and 38 formed respectively in the stationary plate 30 and the adjustment plate 36 to alter the effective open area through which flock fibers 14 in the hopper 12 may pass.

As shown in FIGS. 2 and 4, an impeller 56 is secured to the vertical shaft 40 above the adjustment plate 36 of the metering assembly 16. The impeller has a hub 60 fixed on the shaft 40 by a key 58 for rotation of the impeller along with the shaft. A plurality of impeller blades 62 extend radially outwardly from the hub 60, and terminate slightly short of the inside surface of the hopper cylindrical section 22. Importantly, the impeller blades 62 are angled with respect to the hub 60 so that one side of each blade 62 faces slightly downwardly.

The shaft 40 extends downwardly from the impeller 56 through the metering assembly 16 and the pump housing 18, and has its lower end connected to a motor 66. The motor 66 is suitably connected to a source of power (not shown) for rotating the shaft 40 about its own axis. Such rotation causes the impeller 56 to rotate in the direction of arrow 68 shown in FIG. 2 to urge the flock fibers 14 in the hopper downwardly through the discharge openings 32 and 38 of the metering assembly. The rate of flock feeding through the metering assembly is related to the effective open area of the discharge openings together with the speed of rotation of the impeller 56. Conveniently, the downwardly angled impeller blades sufficiently stir and agitate the flock fibers 14 to break up and prevent clumping or tangling of the fibers, as well as to assure uniform downward metering of the fibers through the metering assembly 16.

The flock fibers 14 fall through the metering assembly 16 into a collecting funnel 70 immediately below the metering assembly. The collecting funnel 70 has an upper, radially outwardly extending flange 72 connected to the lower face of the stationary metering plate 30 by the bolts 28. From the flange 72, the funnel 70 extends downwardly with a circular cross section which radially narrows over a portion of the funnel height. A lower flange 74 is joined to the lower end of the funnel for connection to the upper face 76 of the pump housing 18 by a series of bolts 78.

The pump housing 18 comprises a series of generally rectangular blocks 84, 90 and 94 connected one on top of the other by the bolts 78. The housing 18 in turn is secured to the top of the motor 66 by a series of bolts 80, and the entire apparatus is suitably supported on the housing members 52 by bolts 82 received through the housing members and fastened into the pump housing blocks.

The upper block 84 of the pump housing 18 has a downwardly open passage 86 of circular cross section in alignment with the collecting funnel 70. The passage 86 opens downwardly into a pump chamber 88 of identical circular cross section formed in a central housing block 90. A flat floor 92 for the pump chamber 88 is provided by the upper face of a lower housing block 94.

The vertical shaft 40 extends from the motor 66 upwardly through a tolerance fit opening 95 in the lower block 94, and further upwardly to within the hopper 12.

A lower impeller 96 has a cylindrical hub 98 fixed by a key 100 on the vertical shaft 40 for rotation along with the shaft. The hub 98 rests on the floor 92 of the pump chamber 88, and has a plurality of radially outwardly extending impeller blades 102 which also rest on the pump chamber floor 92. The blades 102 are sized to fit closely within the pump chamber, and to closely sweep the outer walls of said chamber.

Figure 5:
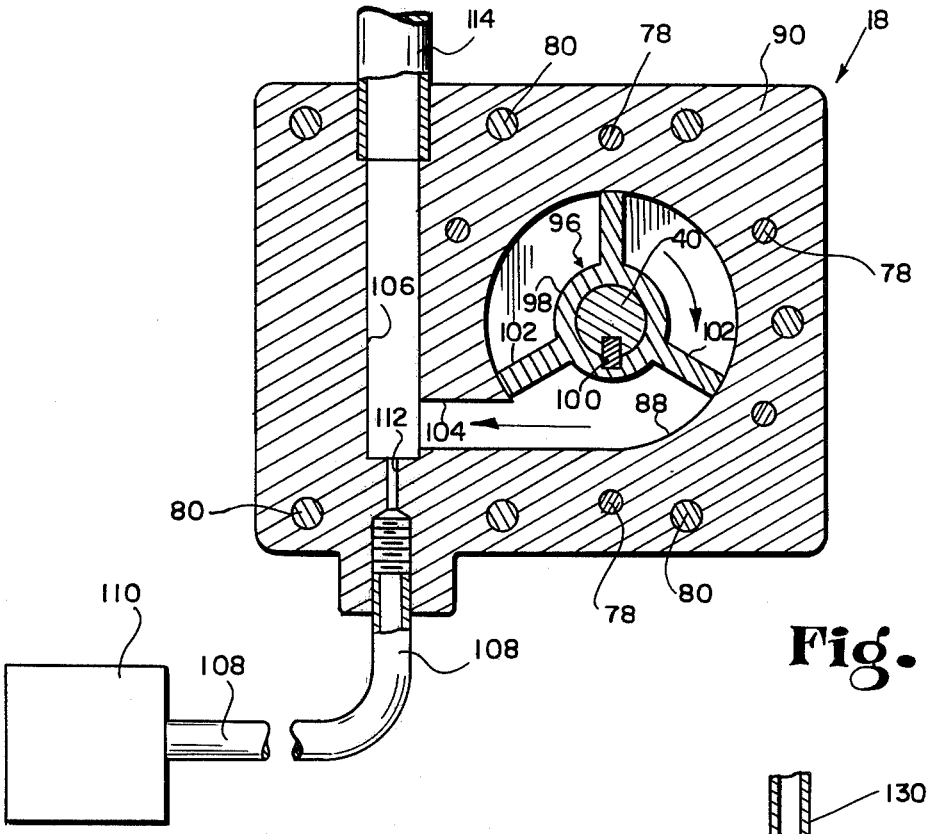
FIG. 5 is a fragmented horizontal section taken on the line 5—5 of FIG. 4.

The lower impeller 96 within the pump chamber 88 rotates within the chamber 88 to continuously sweep falling flock fibers 14 into a pump throat 104 formed in the central housing block 90 in communication with the pump chamber. That is, as shown in FIG. 5, the falling fibers are swept into the open throat by the impeller blades 102. The pump throat 104 is in open communication with a venturi flow tube 106 formed through the central block 90 generally perpendicularly to the pump throat. Specifically, a length of inlet tubing 108 couples a stream of air generated by an air pump 110 to the pump housing 18 for passage through the venturi flow tube 106. The flow tube 106 includes a constriction 112 for temporarily accelerating the air stream to create a substantial suction effect at the termination of the constriction. The pump throat 104 opens into the flow tube 106 at the termination of the constriction so that flock fibers 14 swept into the pump throat are continuously drawn into the venturi flow tube 106 for entrainment with the propelling air stream. The air stream and the entrained fibers exit the flow tube 106 and pass through outlet tubing 114 toward electrostatic charging equipment and an article to be coated with flock fibers.

In one specific working embodiment of the invention, the metering assembly 16 was adjusted to provide a total effective open area for the downward passage of fibers equalling approximately 1.80 square inches. The two impellers 56 and 96 were rotated together by the motor 66 at approximately thirty revolutions per minute. With an air stream supplied through the venturi flow tube 106 at about fifty pounds per square inch, the apparatus of this invention entrained flock fibers in the air stream at a uniform rate of approximately one and one-half pounds per minute.

Figure 6:
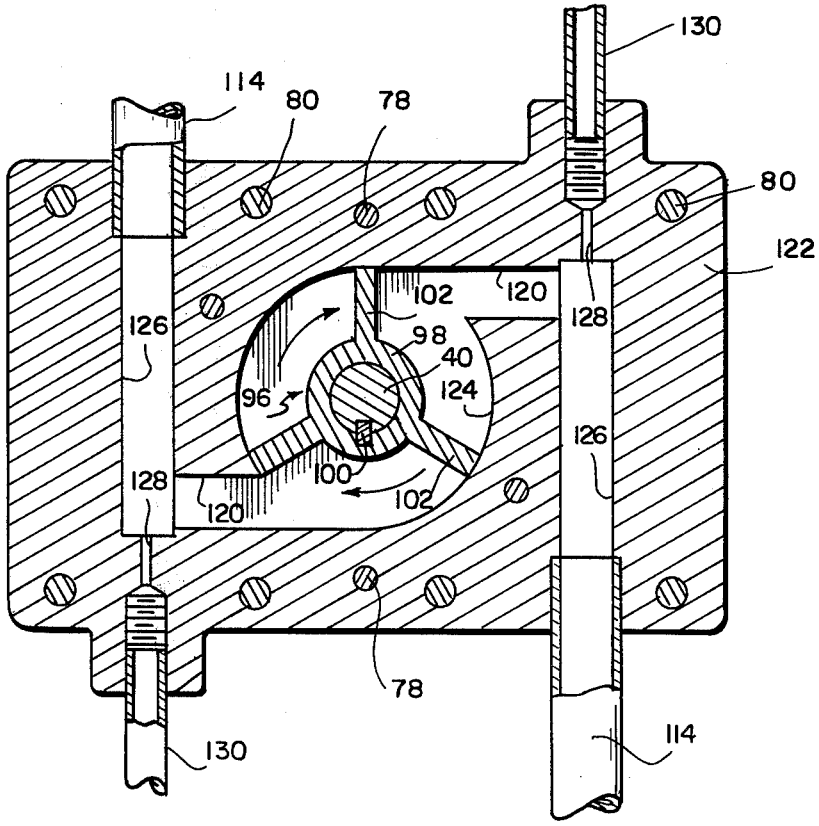
FIG. 6 is a fragmented horizontal section similar to FIG. 5 of an alternate embodiment of the invention.

An alternate embodiment of the pump housing 18 is shown in FIG. 6. As shown, a pair of pump throats 120 are formed in the central housing block 122 in communication with the cylindrical pump chamber 124. Falling flock fibers are continuously swept by the blades 102 of the lower impeller 96 into both of the throats 120 as the impeller is rotated. Each of the throats 120 opens into the venturi flow tube 126 immediately downstream of a venturi constriction 128. As before, a propelling air stream is passed through inlet tubing 130 connected between the two flow tubes 126 and an air pump (not shown). With this embodiment, flock fibers are simultaneously entrained in two air streams for supplying a pair of electrostatic charging guns and/or for supplying fibers for coating articles at more than one coating station.

Another embodiment of the invention is shown in FIG. 7. As shown, the hopper construction includes a sweep arm 140 carried on the vertical shaft 40 within the supply hopper 144. The sweep arm 140 is fixed on the shaft by a key 142 for rotation along with the shaft above the impeller 56. The sweep arm extends horizontally outwardly from the shaft 40, and then turns upwardly and outwardly to contact the inside surface of the supply hopper 144. Importantly, the hopper 144 is modified to have a circular cross section so that the sweep arm 140 serves to dislodge any clumps of fibers clinging to the hopper above the impeller 56. The sweep arm 140 causes such fibers to fall downwardly from the inside surface of the hopper for delivery through the metering assembly 16.

I claim:

1. Flock fiber feeding apparatus comprising a fiber-receiving hopper having a downwardly open discharge passage; means for urging flock fibers downwardly through the discharge passage; a pump mounted below the discharge passage and having a pump chamber in communication with the discharge passage, said pump having a pump throat in communication with the pump chamber; a shaft extending substantially vertical within the hopper and within the pump chamber of said pump; an impeller mounted on said shaft within the pump chamber; a motor connected to said shaft for drivingly rotating said shaft so that said impeller sweeps flock fibers into the inlet end of the pump throat; and a venturi flow tube at an angle to and in communication with the outlet end of the pump throat so that flock fibers are drawn by suction out of the throat and into the flow tube when an air stream is passed through said flow tube for entrainment of the fibers with the air stream, said pump throat extending transversely to the shaft.

2. Flock fiber feeding apparatus as set forth in claim 1 wherein said means for urging flock fibers downwardly through the discharge passage includes a metering assembly having a plurality of downwardly open discharge openings and a second impeller rotatably mounted above the discharge openings.

3. Flock fiber feeding apparatus as set forth in claim 2 wherein said metering assembly comprises a first plate mounted on said hopper under the discharge passage and having a plurality of radially extending openings, and a second plate mounted on said first plate for relative rotation with respect to said first plate and having a plurality of radially extending openings, said second plate including means for controllably rotating said second plate with respect to said first plate.

4. Flock fiber feeding apparatus as set forth in claim 3 wherein said means for controllably rotating said second plate comprises an arm extending outwardly from said second plate, and control means connected to said arm for controllably moving said arm for rotating said second plate with respect to said first plate.

5. Flock fiber feeding apparatus as set forth in claim 3 wherein said first and second plates are mounted on said shaft extending vertically through said metering assembly, said shaft serving to align said first and second plates on a common axis.

6. Flock fiber feeding apparatus as set forth in claim 5 wherein said second impeller is mounted on said shaft for rotation therewith, and said driving means comprises a motor connected to said shaft for rotatably driving said shaft.

7. Flock fiber feeding apparatus as set forth in claim 5 wherein said shaft extends through the pump chamber of said pump, and said driving means comprises a motor connected to said shaft for rotatably driving said shaft.

8. Flock fiber feeding apparatus as set forth in claim 2 including a funnel connected between said metering assembly and said pump for guiding flock fibers passing downwardly through said metering assembly into the pump chamber of said pump.

9. Flock fiber feeding apparatus as set forth in claim 1 wherein said pump has a plurality of pump throats in communication with the pump chamber, and including a plurality of venturi flow tubes respectively in communication with the pump throats.

10. Flock fiber feeding apparatus comprising a fiber-receiving hopper having a downwardly open discharge passage; a metering assembly mounted on said hopper under the discharge passage and having a plurality of downwardly open discharge openings, said assembly including means for selectively varying the size of said discharge openings; an upper impeller rotatably mounted above said metering assembly for urging flock fibers downwardly through the discharge openings; a pump having a pump chamber for receiving flock fibers passed downwardly through the discharge openings, said pump having a pump throat in communication with the pump chamber; a lower impeller rotatably mounted within the pump chamber about a substantially vertical axis for sweeping flock fibers into the inlet end of the pump throat; means for rotatably driving said first and second impellers; and a venturi flow tube at an angle to and in communication with the outlet end of the pump throat so that flock fibers are drawn by suction out of the throat and into the flow tube when an air stream is passed through said flow tube for entrainment of the fibers within the air stream, said pump throat extending transversely to the axis.

* * * * *